US005904122A

United States Patent [19]

Hayd

[11] Patent Number: 5,904,122

[45] Date of Patent: May 18, 1999

[54] GAS EXHAUSTING SYSTEMS FOR MOTORCYCLE ENGINES

[76] Inventor: Juan Gerardo Hayd, Don Bosco 2649, San Isidro, Buenos Aires, Argentina

[21] Appl. No.: 09/026,774

[22] Filed: Feb. 20, 1998

[51] Int. Cl.[6] ..... F02B 75/02

[52] U.S. Cl. ..... 123/65 V; 123/65 PE

[58] Field of Search ..... 123/65 PE, 65 U

[56] References Cited

U.S. PATENT DOCUMENTS 4,660,514 4/1987 Nerstrom ..... 123/65 PE 5,107,801 4/1992 Huang ..... 123/65 PE

*Primary Examiner*—Noah P. Kamen

*Attorney, Agent, or Firm*—Sterne, Kessler, Goldstein & Fox P.L.L.C.

[57] ABSTRACT

The present invention is referred to an exhausting valve lid for motorcycles comprising a lid body including several orifices for fastening said lid to the motorcycle engine. Said lid includes means for controlling the force to be applied to the exhausting valve regulating means, controlling therefore the time at which the exhausting valve is to be opened. Said means for controlling the force to be applied comprises a hollow housing projected from the outer surface of lid body, said housing receives a cylindrical hollow aluminum bolt engaged to a pressing spring coupled to said exhausting valve regulating means.

6 Claims, 2 Drawing Sheets

GAS EXHAUSTING SYSTEMS FOR MOTORCYCLE ENGINES

FIELD OF THE INVENTION

The present invention is related to motorcycle engines, and more particularly is referred to improvements in a gas exhausting system of a motorcycle engine.

BACKGROUND OF THE INVENTION

Every internal combustion engine needs an exhausting valve. This valve regulates the time at which the combustion gas exits the engine's cylinder. There are several exhausting valve designs for each engine, depending on the type of engine used, on the use assigned to the engine, etc. Basically, an exhausting valve comprises a valve head for closing the cylinder exhausting outlet, and a valve body coupled to operating means for opening and closing said valve. Said operating means usually comprises cams, cams shaft, springs and valve seats, said cam shaft is engaged to the engine, said cam works on valve body for opening said valve, and said spring regulates the linear movement of the valve body.

In the particular case of motorcycle engines, a difference between two-stroke engines and four-stroke engines should be pointed out. Four-stroke engines have a structure similar to automobile's engines, but the two-stroke engines differs due to the cycle's characteristics. Even when in general terms every internal combustion engine includes the above cited means, in this particular case of motorcycle engines the exhausting system is defined by particular features. For example, the gas exhausting system includes two valve bodies connected to regulating means for opening said valve once the engine reaches a predetermined number of revolutions per minute (rpm). That is said valve bodies are closed due to the closing force applied by springs included in said regulating means, once the engines shaft reaches a predetermined number of revolutions per minute (5000 rpm for example) the cylinder internal pressure overcome said spring force and the valve bodies are opened. In accordance with the applicant's knowledge the are no regulating means for controlling the above cited force applied by the springs to the valve body. Engine manufacturers preset the valve arrangement and this feature cannot be regulated or controlled by user.

Therefore there is a market need for an improvement in motorcycle engines through which the force applied to the valve's body can be regulated by the user without specialists help, since said regulation improves the engine's performance as it will be demonstrated below.

SUMMARY OF THE INVENTION

It is an object of the present invention providing a new and improved exhausting valve lid including a spring for controlling the force applied by a spring to said regulating means.

It is another object of the present invention providing an exhausting valve lid including regulating means which can be operated directly by the user without specialists help. The user can regulate the force applied to the valve's body only by turning round a control screw included in said valve's lid. This can be done with a regular screwdriver and without any further help.

It is a further object of the present invention to provide a new and improved exhausting system for a motorcycle engine by which the general engine's performance is improved by obtaining a greater power than the regular engines with regular exhausting systems, as it will be demonstrated below.

The improvements could be summarized as follows:

- improves engine's performance on low-mid and top end with less RPM's,
- increases more than 4 HP on top end,
- maximum traction,
- the motorcycle can be dominated at every corner, jumps and landing,
- stop the abuse on motorcycle's clutch,
- less abuse on the entire engine and transmission,
- decrease stalling,
- a better clutch performance can be get by less use of same,
- the power is needed on the engine can be regulated on site on the spot without a mechanic and without opening the engine,
- the rider can obtain a greater concentration on his riding performance than on engine's performance.

BRIEF DESCRIPTION OF THE INVENTION

The above cited advantages are obtaining by using the present invention which comprises a new and improved exhausting valve lid including regulating means for controlling the force applied to the valve's body. Said regulating means comprises a controlling bolt which can be rotated and set in several positions. Each position corresponds to a different force to be applied to the valve's body. That is, the former system through which the valve's spring is set and regulated by the engine's manufacturer is replaced by this new system by which the user can rotate said controlling bolt and therefore can control the force applied to the valve's body. As the bolt is rotated the force is increased because the bolt press the spring and said spring press the valve's body. As the force applied is increased said valve's body will be opened later, that is the spring pressure delays the valves opening. The result obtained is a better engine's performance as well as greater power obtained.

DETAILED DESCRIPTION OF THE INVENTION

Figure 1A:
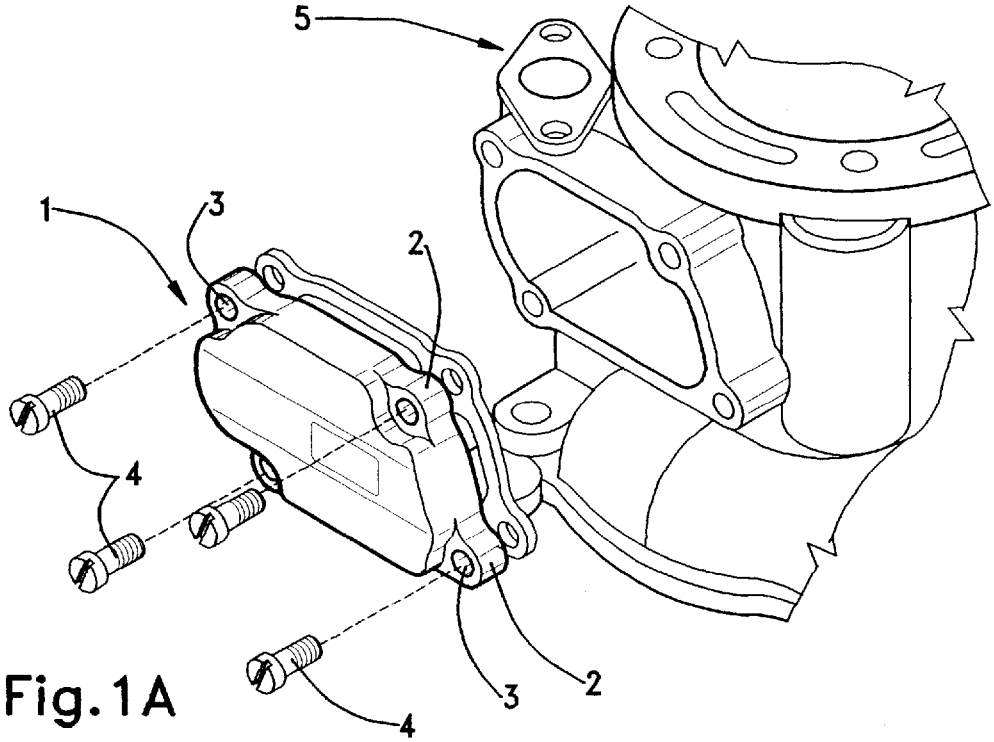
FIG. 1A is a top perspective view of the exhausting valve lid of the prior art.
Figure 4:
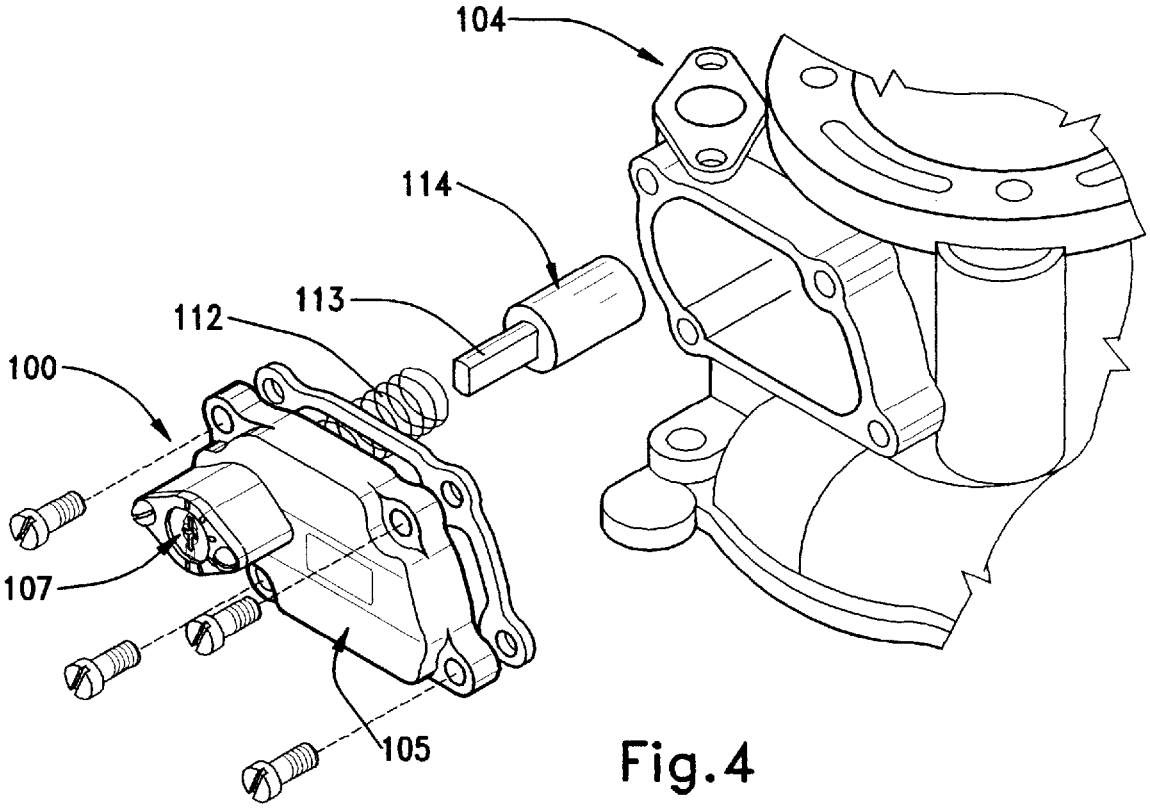
FIG. 4 is a top plan view illustrating said controlling bolt and the different marks cutting in the bolt frame.
Figure 1B:
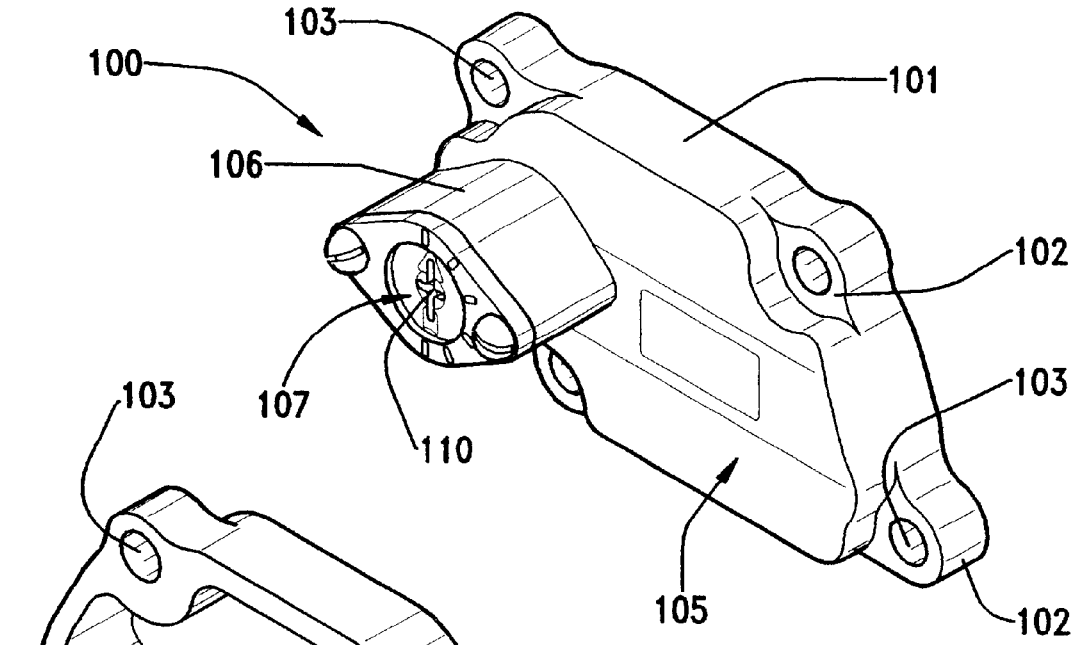
FIG. 1B is a top perspective view of the exhausting valve lid of the present invention.
Figure 2:
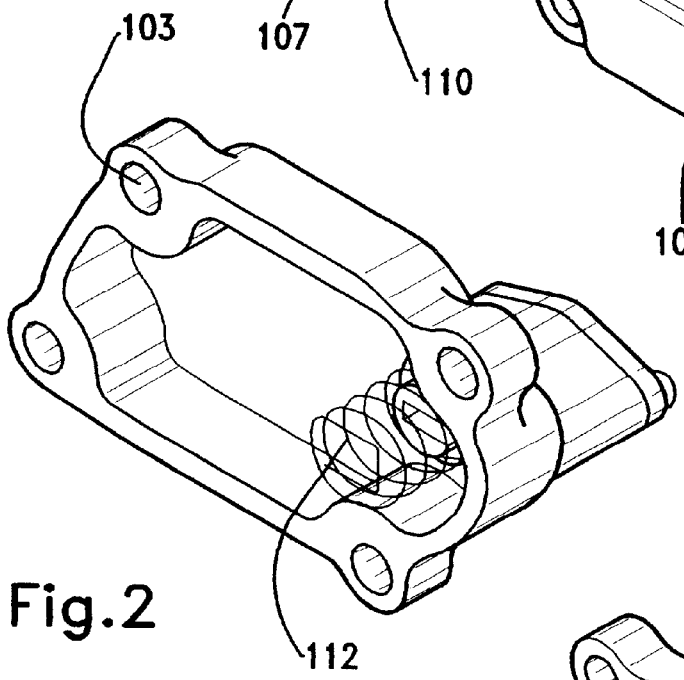
FIG. 2 is a rear perspective view of said lid from which the spring attached to the controlling bolt is clearly shown.
Figure 3:
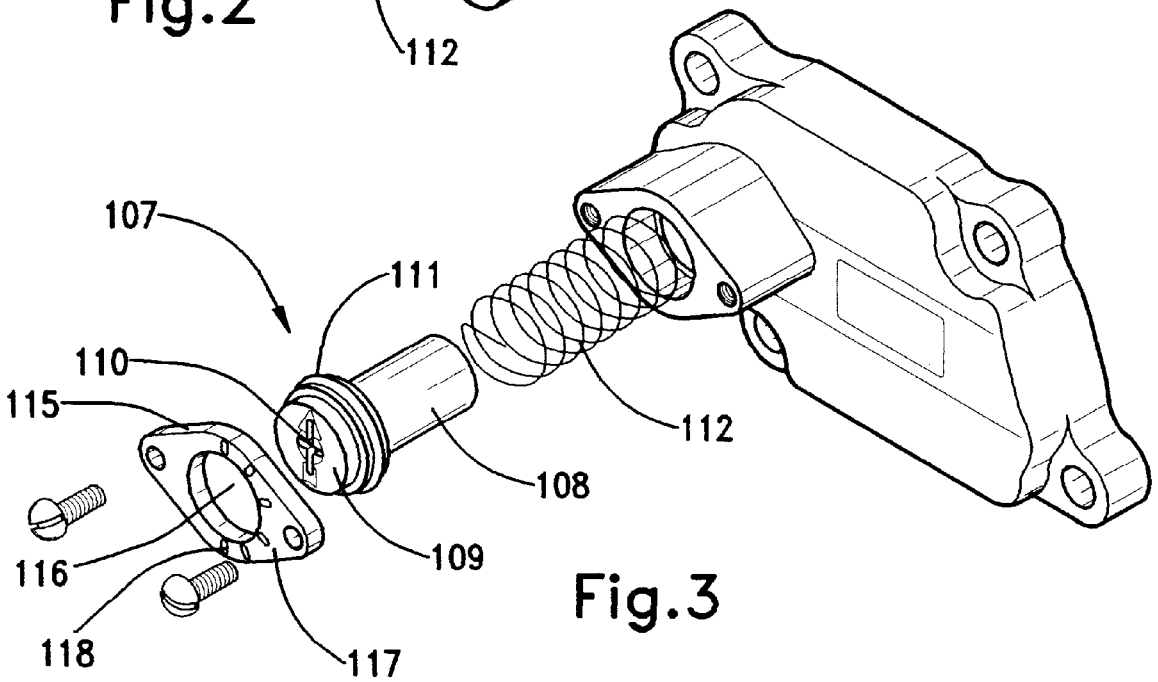
FIG. 3 is another top perspective view illustrating the above cited controlling means in a exploded position.

An exhausting valve lid of the prior art generally indicated as 1 is illustrated in FIG. 1A. Said lid 1 includes an aluminum lid body 2 with holes 3 pierced by fastening screws 4 which fix said lid 1 to the engine body 5. All this means belongs to the prior art and they can be seen on any HONDA CR 125 motorcycle engine. The details of said regulating means are not included and detailed in this specification as they do not form part of the invention purposed. The use of the present invention does not involve any change in the engine valve mechanism, only the exhausting valve lid is changed. Said regulating means promotes to the valve's opening controlling the time at which the valve is to be opened. When the closing force exerted by said valve is lesser than the opening force exerted by the inner cylinder pressure the valve is opened. The object of the present invention resides on regulating said closing force exerted by said valve by which is regulated the time at which said valve is opened. This work can be done by the user unlike to the prior art devices that are regulated by the manufacturer at the time the engine is assembled.

As illustrated in FIGS. 1B–4 the exhausting valve lid 100 of the present invention comprises a lid body 101 with corner lugs 102 each of which includes an orifice 103. Fastening screws pierce said orifices for fastening said lid body 101 to the engine's body 104. The front surface 105 of said lid body 101 includes a projecting hollow housing 106 whose cross-section defines a rounded-apex rhombus. Said hollow housing 106 receives controlling means 107 comprising a cylindrical hollow aluminum bolt 108 the front face 109 of which includes a groove 110 for adjusting the force to by applied by the spring as will be described in detail below. The perimetrical shape of said groove could be an arrow-like groove as is illustrated in the accompanying drawings, indicating to the user the position in which said controlling means is set.

Adjacent to said front face 109 said cylindrical bolt 108 includes an o-ring 111 for leakproof fitting said bolt 108 in said hollow housing 106. Said cylindrical hollow bolt 108 is hosted in the hollow housing 106 and the end of said bolt is engaged to a pressing spring 112. Said spring 112 will press the exhausting valve controlling means (not illustrated) and will regulate the time at which said valve is opened depending on the engine's regime. The spring 112 will increase said closing force on said exhausting valve, and this closing force to be applied on said exhausting valve controlling means can be regulated directly by user. This is the main difference between the prior art exhausting valve lid and the present invention. In the present case said closing force can be regulated by user by introducing the end of a regular screwdriver in the above cited groove 110 turning round said bolt 108. There are several positions in which the bolt could be set, the first mark will correspond to the smallest pressure, and the last mark corresponds to the highest one, each position produces different results on engine performance as it will be explained in detail below. Therefore the time at which said exhausting valve will be opened is also regulated.

Finally an adjusting frame 115 including a central opening 116 for projecting the bolt's front face 109 is screwed to said housing 106. This is for avoiding any accidental rotation of said bolt 108 during motorcycle operation. On the outer surface 117 of frame 115 several indicating marks 118 are included in order to show to the user the position at which the bolt 108 is set.

Now it will be clearly explained the operation and function of the invented exhausting valve lid. When the user wants to improve engine performance for example for riding motorcycle races, the original regular exhausting valve lid is unscrew from the engine. Then the new invented lid is screwed to the engine as the orifices 103 coincide with the fastening engine orifices. At the same time spring 112 is engaged to the exhausting valve regulating means (not illustrated) . Said spring 112 is coaxially hosted on pin head 113 of pin 114. The regular means for operating on said exhausting valve regulating means is defined by said regular pin 114.

In order to adjust the pressure to be applied by spring 112 to said valve regulating means (more specifically on pin 114) the user must turning round bolt 108 with a screwdriver. The first position corresponds to the smallest pressure and the last one with a highest pressure. A pressure higher than the regular pressure applied to said valve regulating means by said spring 112 will promote a delayed opening of said valve. Said delayed opening will lead to a better engine performance at low rates, which is a beneficial engine's feature during a motorcycle race. At the same time the user turn the bolt 112 round the pressure on the valve regulating means is increased and the valve opening is delayed. The last bolt position corresponds to the greatest pressure on the valve regulating means and the greatest delay in valve opening.

What is claimed is:

1. An exhaust valve lid for a motorcycle engine comprising a lid body including an orifice for fastening said exhaust valve lid to said motorcycle engine, wherein said exhaust valve lid includes a user adjustable controller for controlling the closing force applied by an exhaust valve regulator disposed in said engine to an exhaust valve of said engine, thereby controlling the time at which said exhaust valve is to be opened in response to pressure in the engine cylinder.

2. The lid of claim 1, wherein said controller comprises a hollow housing projected from an outer surface of said lid body, said housing receiving a cylindrical hollow aluminum bolt engaged to a spring coupled to said exhaust valve regulator.

3. The lid of claim 2, wherein a front face of said cylindrical bolt includes an o-ring for leakproof fitting of said bolt in said hollow housing.

4. The lid of claim 2, wherein an adjusting frame including a central opening for projecting a front face of said cylindrical bolt is fastened to said hollow housing.

5. The lid of claim 4, wherein said adjusting frame includes several marks indicating to the user the position at which said cylindrical bolt is set.

6. The lid of claim 1, wherein a front face of said cylindrical bolt includes an arrow-shaped groove for introducing a screwdriver tip and turning round said bolt.

* * * * *